US009364691B2

(12) United States Patent
Shieh

(10) Patent No.: US 9,364,691 B2
(45) Date of Patent: Jun. 14, 2016

(54) ESCAPE DEVICE AND USE METHOD THEREOF

(71) Applicant: NATIONAL CHENG KUNG UNIVERSITY, Tainan (TW)

(72) Inventor: Meng-Dar Shieh, Tainan (TW)

(73) Assignee: National Cheng Kung University, Tainan (TW)

( * ) Notice: Subject to any disclaimer, the term of this patent is extended or adjusted under 35 U.S.C. 154(b) by 0 days.

(21) Appl. No.: 14/459,522

(22) Filed: Aug. 14, 2014

(65) Prior Publication Data

US 2015/0090529 A1 Apr. 2, 2015

(30) Foreign Application Priority Data

Sep. 30, 2013 (TW) ..... 102135313 A

(51) Int. Cl.
*A62B 1/20* (2006.01)

(52) U.S. Cl.
CPC ..... *A62B 1/20* (2013.01)

(58) Field of Classification Search
CPC ..... A62B 1/20
See application file for complete search history.

(56) References Cited

U.S. PATENT DOCUMENTS 3,537,094 A * 10/1970 Hawkins ..... G08B 13/06 200/61.64
4,466,507 A * 8/1984 Itano ..... A62B 35/0062 182/3
4,709,782 A * 12/1987 Lipinski ..... A62B 35/0062 182/3
7,111,436 B2 * 9/2006 Saiz ..... A62B 1/20 182/48
7,703,576 B2 * 4/2010 Grabowski ..... A61B 35/0062 182/3
2007/0137928 A1 * 6/2007 Guillermety ..... A62B 1/20 182/48
2010/0193289 A1 * 8/2010 Guillermety ..... A62B 1/20 182/3
2012/0073900 A1 * 3/2012 Cruz ..... E04G 21/3276 182/3

FOREIGN PATENT DOCUMENTS

CA 2032478 A1 * 9/1991 ..... A62B 1/20
DE 4317445 A1 * 11/1994 ..... A62B 1/20
JP S4938160 B1 * 10/1974 ..... A62B 1/20
TW 344279 U 11/1998

* cited by examiner

*Primary Examiner* — Alvin Chin-Shue
(74) *Attorney, Agent, or Firm* — Rosenberg, Klein & Lee

(57) ABSTRACT

The present invention relates to an escape device, involving a tube, a rail member, and a sliding unit. The tube, extending along a longitudinal direction, is provided with an exit end and intermittently with a plurality of escape openings. The rail member includes a plurality of sliding tracks sequentially connected to one another, wherein the neighboring sliding tracks are connected to each other by associating a relatively wide first end with a relatively narrow second end, the second end facing the exit end of the tube. The sliding unit comprises a deformable member which is adapted to slide on the rail member and configured to be pressed against by the second ends of the sliding tracks such that a slide resistance is generated to reduce sliding velocity. Therefore, the effects for the reduction of descending velocity as well as rapid and safe escape are achieved.

9 Claims, 19 Drawing Sheets

ESCAPE DEVICE AND USE METHOD THEREOF

BACKGROUND OF THE INVENTION

1. Field of the Invention

The present invention relates to an escape device, especially to an escape device with a plurality of sliding tracks that are connected to one another, by which a safe escape and buffering descending velocity during the escape are achieved.

2. The Prior Arts

For conventional escape devices, reference is made to Taiwan utility model patent No. 344279, entitled "Device for rapid escape from high building during a fire accident", which comprises: an escape device pre-installed in a building structure. The building structure principally has a slow-descending room pre-arranged therein and a slow-descending tube disposed within the slow-descending room. The combination of these components can be served as a high building escape device. Further, each floor of the building has at least one escape exit which is simple for use and suitable for rapid escape, whereby staffs can quickly get to the escape exits and escape right away when a fire accident occurs.

However, the abovementioned device has the following disadvantages:

1. An elastic hoop is utilized to slow down descending velocity of users. However, when the body size of users is smaller than the orifice defined by the elastic hoop, users shall rapidly pass through the elastic hoop and thus cannot be slowed down.

2. Although a sponge pad is provided to reduce impact velocity of users, the sponge pad is not safe anymore once damaged and shall adversely affect the landing safety of users. Moreover, the sponge pad occupies too much space of the building. Therefore, the abovementioned invention does not have the effects of space saving and safe landing.

3. The abovementioned invention is designed only for users to reduce impact velocity during the escape. However, there is no monitoring unit in the abovementioned invention for monitoring whether a stranger is bursting into the building and avoiding the situation that a thief makes use of the abovementioned invention to burst into the building. Therefore, the abovementioned invention does not have considerations of monitoring and preventing a stranger from bursting into the building.

SUMMARY OF THE INVENTION

In view of the aforesaid disadvantages of the prior art, the present invention provides an escape device and a use method of the same.

In one aspect of the present invention, an escape device includes a rail member and a sliding unit. The rail member extends along a longitudinal direction which is a direction of gravity and includes a plurality of sliding tracks sequentially connected to one another along the longitudinal direction. Each of the sliding tracks is provided with a relatively wide first end and a relatively narrow second end, and the second end of each respective sliding track is connected to the first end of another respective sliding track adjacent thereto. The sliding unit includes at least one deformable member with which a hanging member is mounted. The deformable member is adapted to slide on the rail member. When the deformable member slips to the second end of a respective sliding track, the deformable member is pressed against and deformed by the second end of the respective sliding track such that a slide resistance is generated between the deformable member and the second end of the respective sliding track to reduce the sliding velocity of the deformable member.

Preferably, the escape device further comprises a tube extending along the longitudinal direction, wherein a lower portion of the tube has an exit end provided with an exit opening. At least one escape opening is also provided on the tube along the longitudinal direction. The at least one escape opening corresponds in position to at least one escape hatch of a building, respectively. The rail member is mounted on an inner surface of the tube. The second ends of the sliding tracks face the exit end of the tube.

Preferably, the hanging member comprises a hook element.

Preferably, the deformable member is deformable when a force is applied and is allowed to return to an original state once the force is removed.

Preferably, the deformable member is elastic.

Preferably, the deformable member includes two supporting rods which are arranged in a cross manner and pivotally connected to each other. The two supporting rods each have a roller wheel mounted thereon such that the deformable member is slidable on the rail member via the roller wheels. The two supporting rods have a spring element connected therebetween.

Preferably, the deformable member includes a pivot rod having a first end pivotally connected with two supporting rods and a second end mounted with a connecting rod. Each of the two supporting rods is provided with a roller wheel for sliding on the rail member. The connecting rod has two ends each of which is provided with a magnetic component. The magnetic components are opposite to each other with the same magnetic pole.

Preferably, at least one monitoring unit and an alarm unit are mounted at the exit opening of the tube, and the monitoring unit is electrically connected to the alarm unit.

Preferably, each of the sliding tracks is tapered from the first end to the second end.

In another aspect of the present invention, an auxiliary escape method comprises the steps of: mounting a rail member outside a building, wherein the rail member includes a plurality of sliding tracks which are sequentially connected to one another and each are tapered from top to bottom; putting a sliding unit into the rail member once the sliding unit is connected to an escaping person, wherein the sliding unit is configured to be pressed against by the sliding tracks of the rail member; and forcing the sliding unit to slip through the sliding tracks of the rail member by a body weight of the escaping person such that the sliding unit is sequentially pressed against and deformed by the sliding tracks and is slowed down due to a slide resistance generated between the sliding unit and each of the sliding tracks.

Preferably, the sliding unit is deformed when being pressed against by the sliding tracks.

Preferably, each of the sliding tracks is deformed once pressing against the sliding unit.

In yet another aspect of the present invention, an escape device comprises a tube, at least one pair of rail members, and at least one sliding unit. The tube extends along a longitudinal direction and is provided with an exit opening and a plurality of escape openings. The plurality of escape openings is intermittently arranged along the longitudinal direction. The at least one pair of rail members are oppositely mounted in the tube, wherein the pair of rail members constitute a sliding track. The sliding track has a relatively wide first end and a relatively narrow second end, the sliding track is tapered from the first end to the second end and is mounted on an inner surface of the tube via the first end. The second end of the sliding track faces the exit end of the tube. The first end of the sliding track is connected to a second end of an adjacent sliding track which is constituted by another pair of rail members. The at least one sliding unit includes a hanging member. The sliding unit is adapted to slide on the sliding track and is configured to be pressed against and deformed by the sliding track.

Preferably, the first end of the sliding track is provided with at least one fixing hole.

Preferably, the second end of the sliding track is elastically expandable in a transverse direction and thereby allows the sliding unit to slip through.

Preferably, the escape device further comprises a spring component mounted at the contact site between the second end of the sliding track and the tube in order to assist the second end of the sliding track in rebounding transversely. The sliding track is configured to exert a compressive force on the sliding unit to gradually reduce sliding velocity of the sliding unit and achieve a buffering effect.

The present invention has the following effects:

1. The present invention involves a plurality of sliding tracks sequentially connected to one another, wherein each sliding track comprises a relatively wide first end and a relatively narrow second end, and each respective sliding track is connected to one another by associating the first end with the second end. When the sliding unit slips down to the second end, the deformable member of the sliding unit is pressed against and deformed by the second end and thus a slide resistance is generated to reduce sliding velocity of users. Therefore, the present invention has the effects for the reduction of descending velocity, rapid and safe escape as well as slow descending.

2. The present invention involves a storage unit which is arranged beside an escape hatch and adapted for storing the sliding unit, which is needed for the escape, thus preventing the sliding unit from being lost or damaged. Therefore, the present invention has an effect for the storage.

3. The present invention involves the sliding units with different deformation resistance, which can be selectively used based upon the body weight of an individual users, so it can be avoided on one hand that an user with relatively high body weight, such as an adult, makes use of the sliding unit with low deformation resistance for escape and thus gets hurt because the descending velocity in the course of the escape cannot be effectively reduced; on the other hand, it can be also avoided that an user with relatively low body weight, such as a child, makes use of the sliding unit with high deformation resistance for the escape and the descending in the course of the escape is thus too slow so that the escape is hindered. Therefore, the present invention has an effect for individual use.

4. The present invention involves a monitoring unit mounted at the exit opening of the tube, for monitoring whether a stranger is bursting into the building; when an abnormality emerges, the unit shall give an alarm to building dwellers to prevent undesired stranger from bursting into the building. Therefore, the present invention has the effects for monitoring and preventing strangers from bursting into a building.

5. The present invention involves two rail members which constitute a sliding track, and the sliding track is tapered from a relatively wide first end to a relatively narrow second end; when the sliding unit slips down to the second end, the deformable member of the sliding unit is pressed against and deformed by the second end and thus a slide resistance is produced to gradually slow down the sliding velocity of the sliding unit, and thereby achieving the effects for rapid and safe escape as well as slow descending.

DETAILED DESCRIPTION OF THE PREFERRED EMBODIMENT

Figure 1:
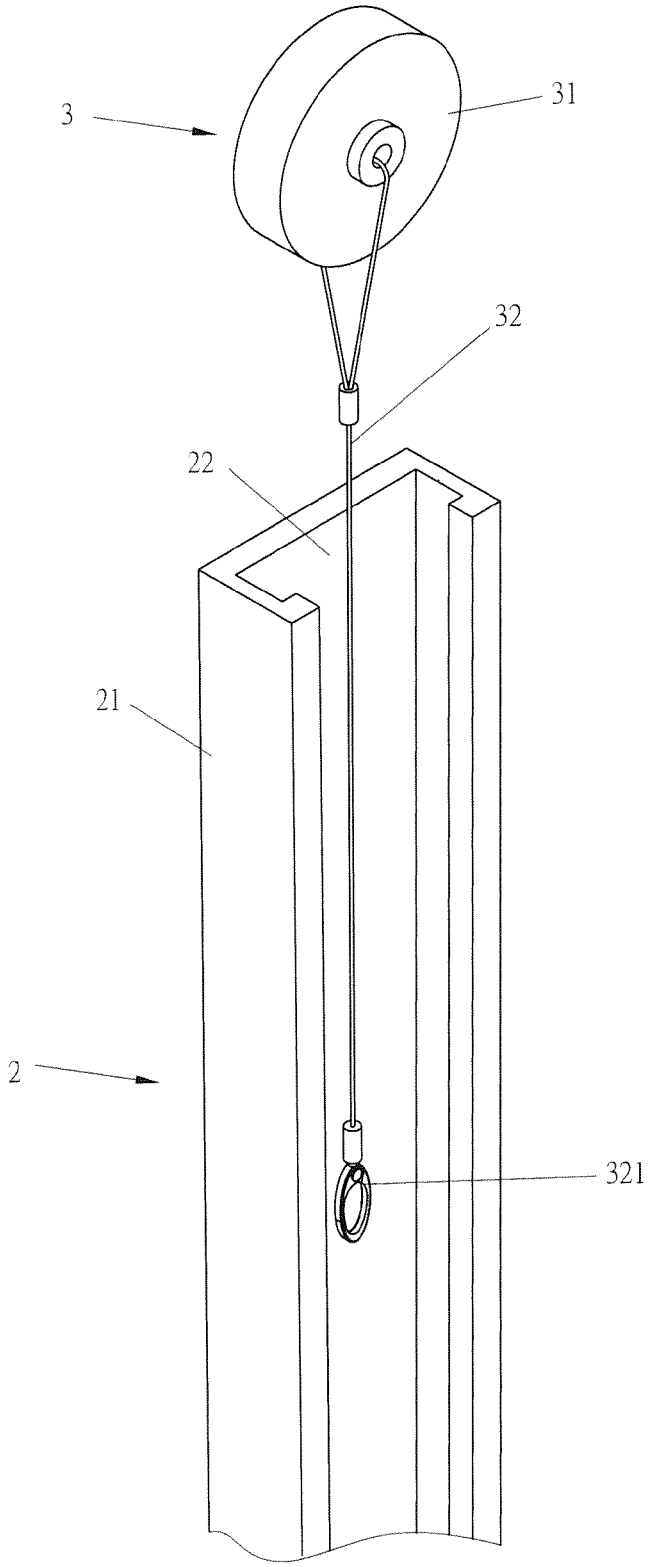
FIG. 1 is a perspective view of an escape device according to an embodiment of the present invention.

Taken the foregoing technical characteristics together, the escape device and use method thereof according to the present invention can be explicitly demonstrated in the following embodiments.

FIGS. 1 to 7 show the structure of an escape device according to a first embodiment of the present invention. The escape device of the first embodiment comprises a tube (1) extending along a longitudinal direction, wherein the longitudinal direction is a direction of gravity. The lower portion of the tube (1) has an exit end (11) provided with an exit opening (12), and also, the tube (1) has a plurality of escape openings (13) intermittently arranged along the longitudinal direction.

A rail member (2) extending along the longitudinal direction is mounted on an inner surface of the tube (1). The rail member (2) includes a plurality of sliding tracks (21) sequentially connected to one another along the longitudinal direction. Each of the sliding tracks (21) has a relatively wide first end (22) and a relatively narrow second end (23); practically, each of the sliding tracks (21) is tapered from the first end (22) to the second end (23). Two neighboring sliding tracks (21) are connected to each other by the first end (22) and second end (23). More specifically, the second end (23) of each respective sliding track (21) is connected to the first end (22) of another respective sliding track (21) which is adjacent. The second ends (23) of the sliding tracks (21) face the exit end (11) of the tube (1).

A sliding unit (3) including at least one deformable member (31) is adapted to slide on the rail member (2). The deformable member (31) is mounted with a hanging member (32). The hanging member (32) comprises a hook element (321), such as a snap ring or a carabiner, which can prevent a user from falling off due to incautious operation. Further, the deformable member (31) is configured to be sequentially pressed against and deformed by the second ends (23) of the sliding tracks (21) when sliding along the rail member (2), such that a slide resistance is generated between the deformable member (31) and the second end (23) of each respective sliding track (21) and reduces the sliding velocity of the sliding unit (3) thereby. Preferably, the deformable member (31) is elastic.

Figure 2:
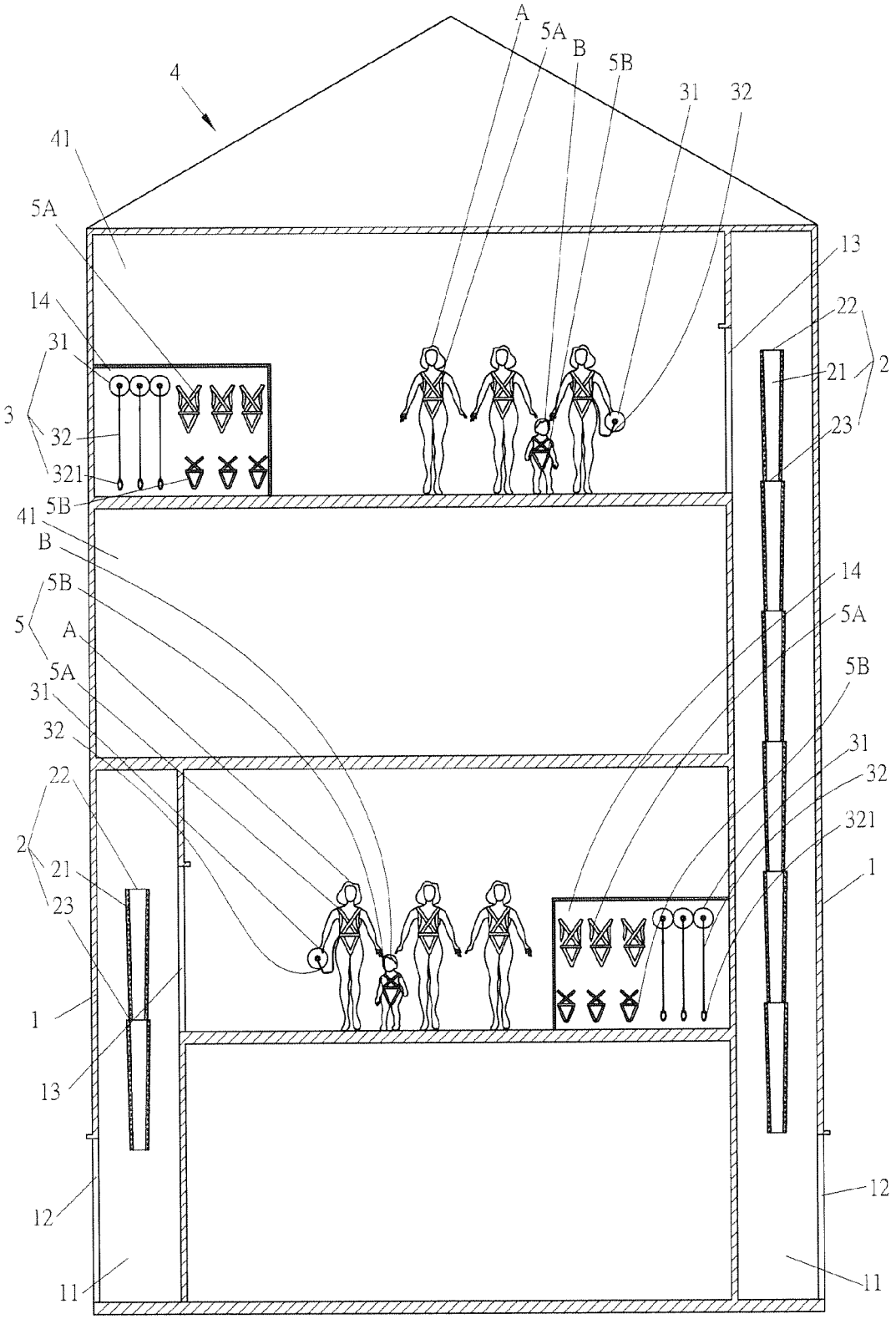
FIG. 2 is a schematic view of an escape device according to a first embodiment of the present invention.
Figure 3:
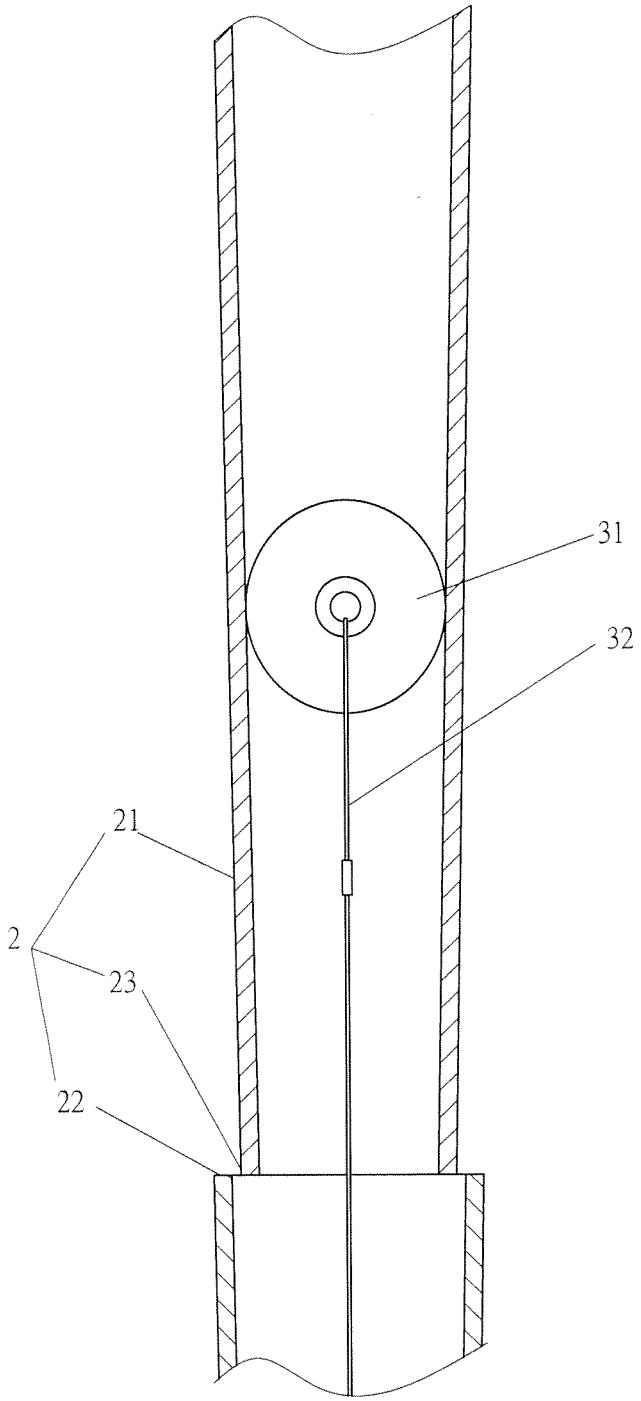
FIG. 3 is a partial schematic view of the escape device depicted in FIG. 1, demonstrating the conformation of the deformable member while the deformable member is located at the relatively wide first end of the sliding track.
Figure 4:
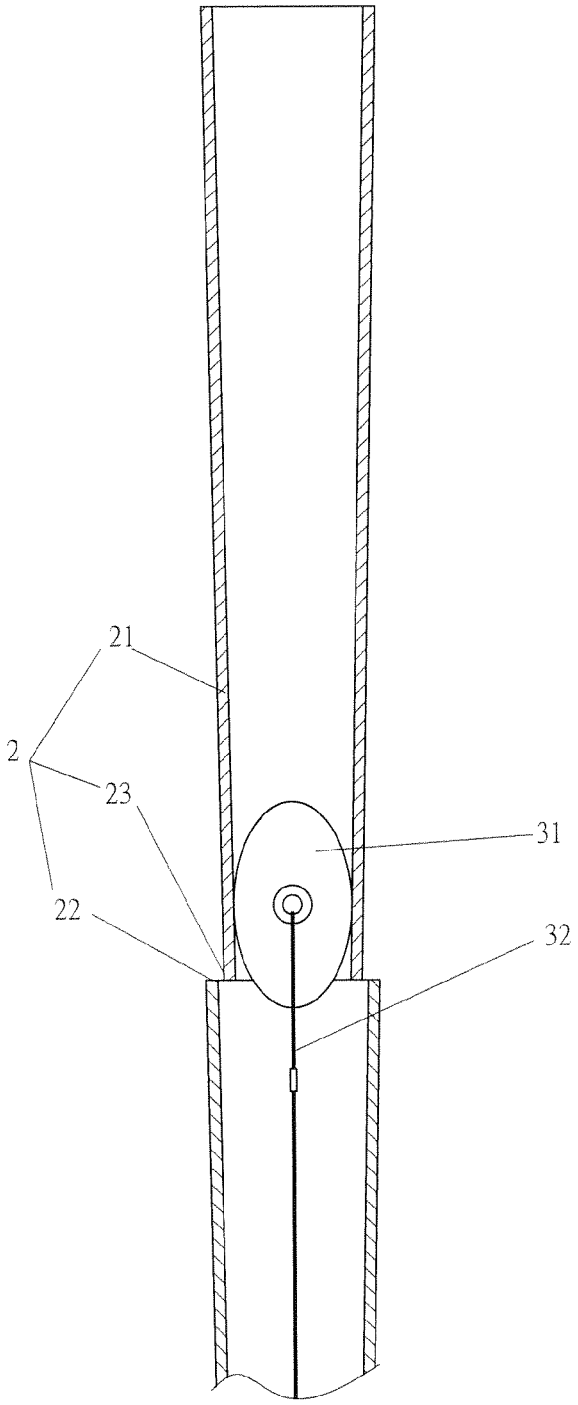
FIG. 4 is another partial schematic view of the escape device depicted in FIG. 1, demonstrating the conformation of the deformable member while the deformable member is located at the relatively narrow second end of the sliding track.

In this embodiment, the tube (1) is constructed integrally with a building (4) and is built adjacent a wall of the building (4) (see FIG. 2). Each floor (41) of the building (4) is provided with an escape hatch which corresponds in position to one of the escape openings (13) of the tube (1), and also, each floor (41) of the building (4) is provided with a storage unit (14) for the storage of the sliding unit (3) and at least one wearing article (5), wherein the user can wear the wearing article (5) and associate it with the hanging member (32) of the sliding unit (3) to escape. Preferably, referring to FIGS. 2, 5 and 6, a plurality of wearing articles (5) of different sizes are stored in the storage unit (14) such that, for example, an adult user (A) of larger body size and a child user (B) of smaller body size can wear a wearing article for adults (5A) and a wearing article for children (5B), respectively.

In the course of the escape, the user can take the sliding unit (3) and the wearing article (5) of adaptive size from the storage unit (14) which is located at a specific floor (41), and after having put on the wearing article (5), the user can associate the hanging member (32) of the sliding unit (3) with the wearing article (5) by means of the hook element (321). Subsequently, the user can put the sliding unit (3) into the rail member (2) from the first end (22) of a respective sliding track (21). Consequently, when the sliding unit (3) is forced to slip through the sliding tracks (21) of the rail member (2) by the user's body weight, the user can descend from the specific floor (41) by means of sling. In more detail, because the sliding tracks (21) each are tapered from the first end (22) to the second end (23), the deformable member (31) of the sliding unit (3) is pressed against and deformed when slipping down to the second end (23) of the respective sliding track (21) such that a slide resistance is generated between the deformable member (31) of the sliding unit (3) and the second end (23) of the respective sliding track (21) and thus reduces the descending velocity of the user. However, once the deformable member (31) of the sliding unit (3) slips out of the second end (23) of the respective sliding track (21) and into the first end (22) of another respective sliding track (21), the deformable member (31) of the sliding unit (3) rebounds immediately and the descending velocity of the user is resumed, thus avoiding wasting too much time for the escape. Therefore, the escape device according to the first embodiment of the present invention has the effects for effectively buffering descending velocity and saving much time for the escape, thus providing a rapid, safe and effective escape.

Figure 5:
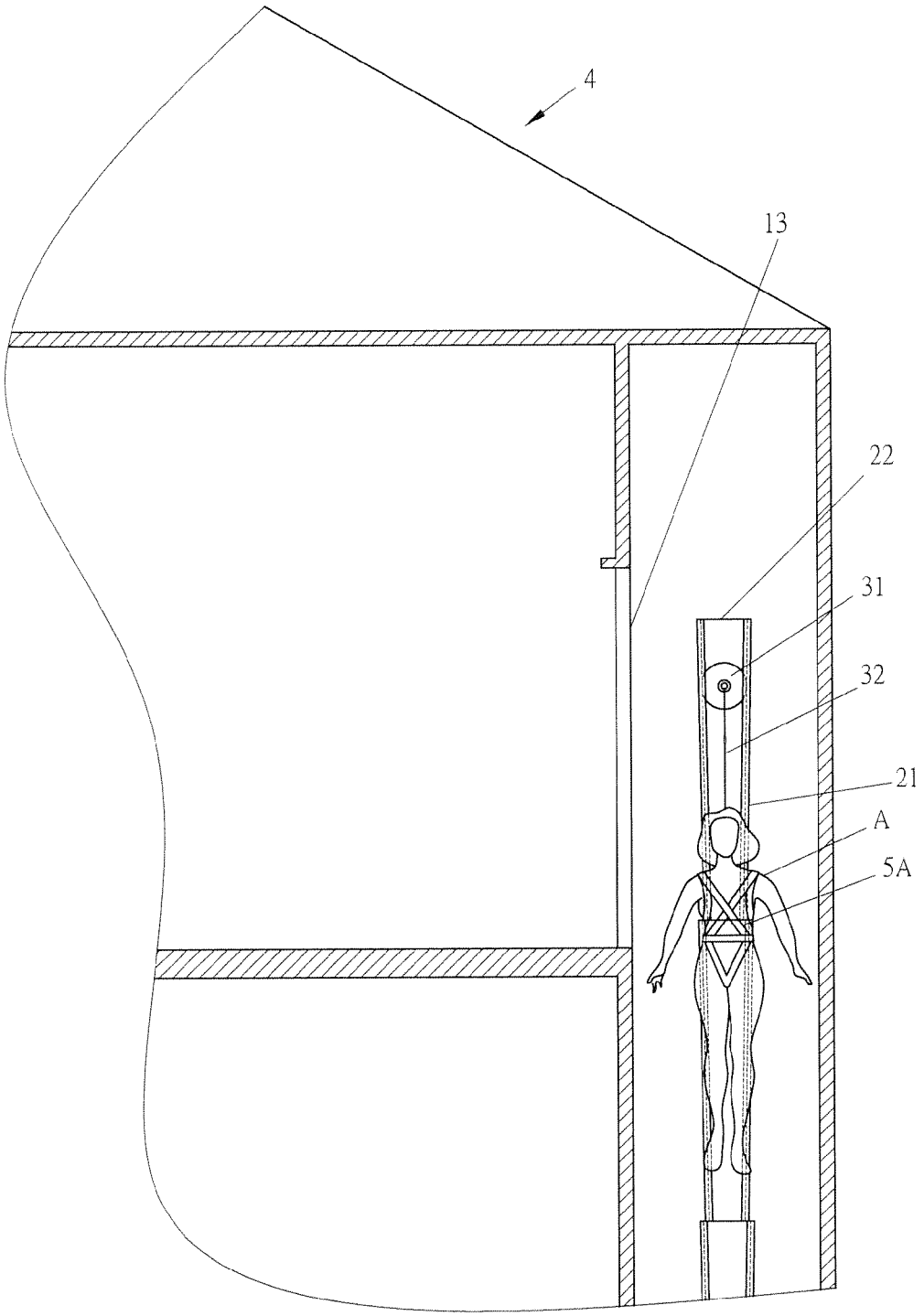
FIG. 5 is another schematic view demonstrating how an adult user of larger body size uses the escape device in FIG. 2 for the escape.
Figure 6:
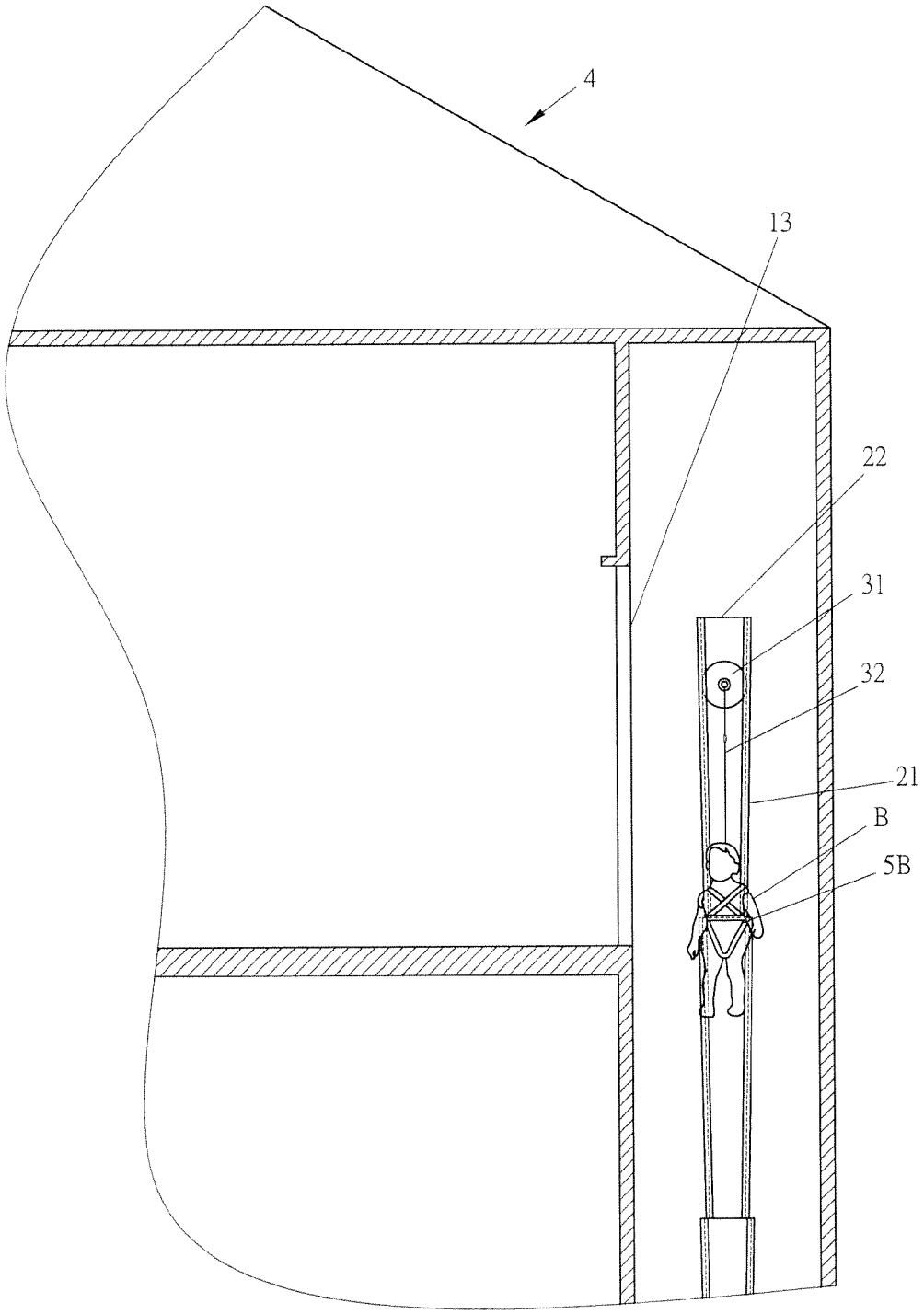
FIG. 6 is still another schematic view demonstrating how a child user of smaller body size uses the escape device in FIG. 2 for the escape.

More specifically, FIG. 5 and FIG. 6 take the adult user (A) and the child user (B) for example, respectively. When desiring to make use of the escape device according to the first embodiment of the present invention for the escape, the adult user (A) may take the sliding unit (3) with relatively high deformation resistance and the wearing article for adults (5A) from the storage unit (14) which is disposed beside one of the escape openings (13) of the tube (1). The sliding unit (3) with relatively high deformation resistance results in a relatively high friction between the sliding unit (3) and the sliding tracks (21) and thus can significantly reduce the descending velocity of the adult user (A). Moreover, the deformation of the sliding unit (3), caused by the relatively high friction, can further decrease the descending velocity of the adult user (A). This enables the adult user (A) to be free from nervousness and anxiety during the escape. In another aspect, this also can prevent the adult user (A), who has higher body weight, from getting hurt because of the sliding unit (3) of which deformation resistance is too low to slow down the descending velocity of the adult user (A) in the course of the escape. Therefore, a user who has higher body weight can rapidly and safely descend through the escape device of the present invention.

Likewise, when a child user (B) wants to make use of the escape device according to the first embodiment of the present invention for the escape, the sliding unit (3) with relatively low deformation resistance and the wearing article for children (5B) may be taken from the storage unit (14) which is disposed beside one of the escape openings (13) of the tube (1). The sliding unit (3) with relatively low deformation resistance leads a relatively low friction between the sliding unit (3) and the sliding tracks (21) so that the descending velocity of the child user (B) can be properly reduced to a suitable value. Meanwhile, the deformation of the sliding unit (3), resulted from the relatively low friction, also slows down the descending velocity of the child user (B). This enables the child user (B) to be free from nervousness and anxiety during the escape. In another aspect, due to the relatively low friction, the child user (B) can descend smoothly at a moderate velocity, such that the child user (B), who has lower body weight, will not descend too slowly or get stuck in the tube (1) and thus can avoid getting hurt during the escape. Therefore, the present invention fulfills the purpose of allowing users with relatively low body weight to escape.

Based upon the abovementioned FIG. 5 and FIG. 6, users with different body weights can escape separately using the sliding unit (3) with relatively high or low deformation resistance. Therefore, the present invention has the effect for assisting users with different body weights in the escape.

Figure 7:
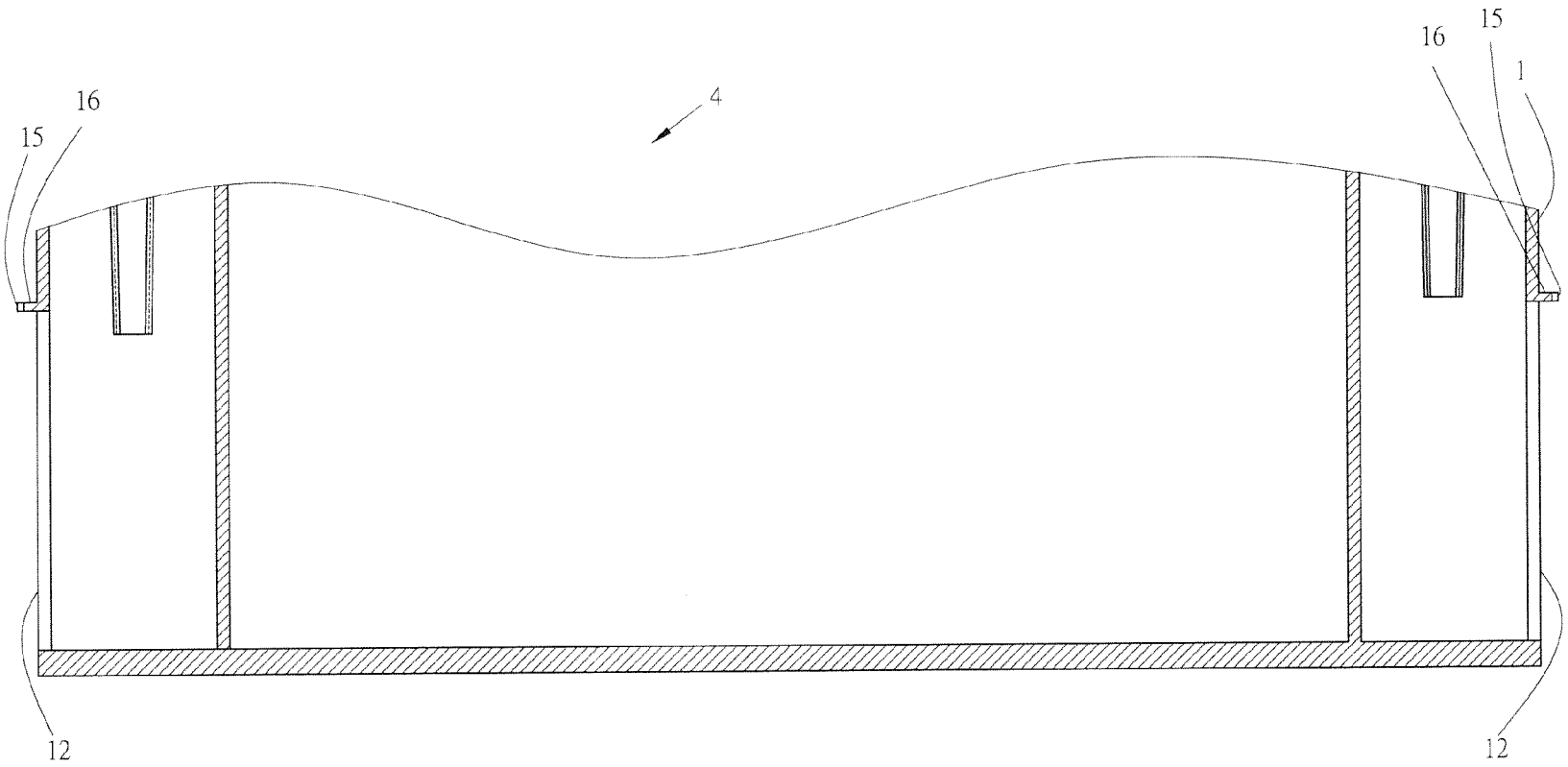
FIG. 7 is yet another schematic view demonstrating how a monitoring unit and an alarm unit are provided at the exit opening of the tube of the escape device in FIG. 2 for the purpose of preventing a stranger from invading the building.

As shown in FIG. 7, the present invention preferably has at least one monitoring unit (15) and an alarm unit (16) which are mounted at the exit opening (12) of the tube (1) and electrically connected to each other. The monitoring unit (15) serves to monitor whether a stranger invades the building (4), and the alarm unit gives an alarm to building dwellers if any abnormality is monitored. Hence, the escape device according to this embodiment of the present invention can be not only used for the escape, but also for monitoring and preventing strangers from entering the building (4).

Figure 8:
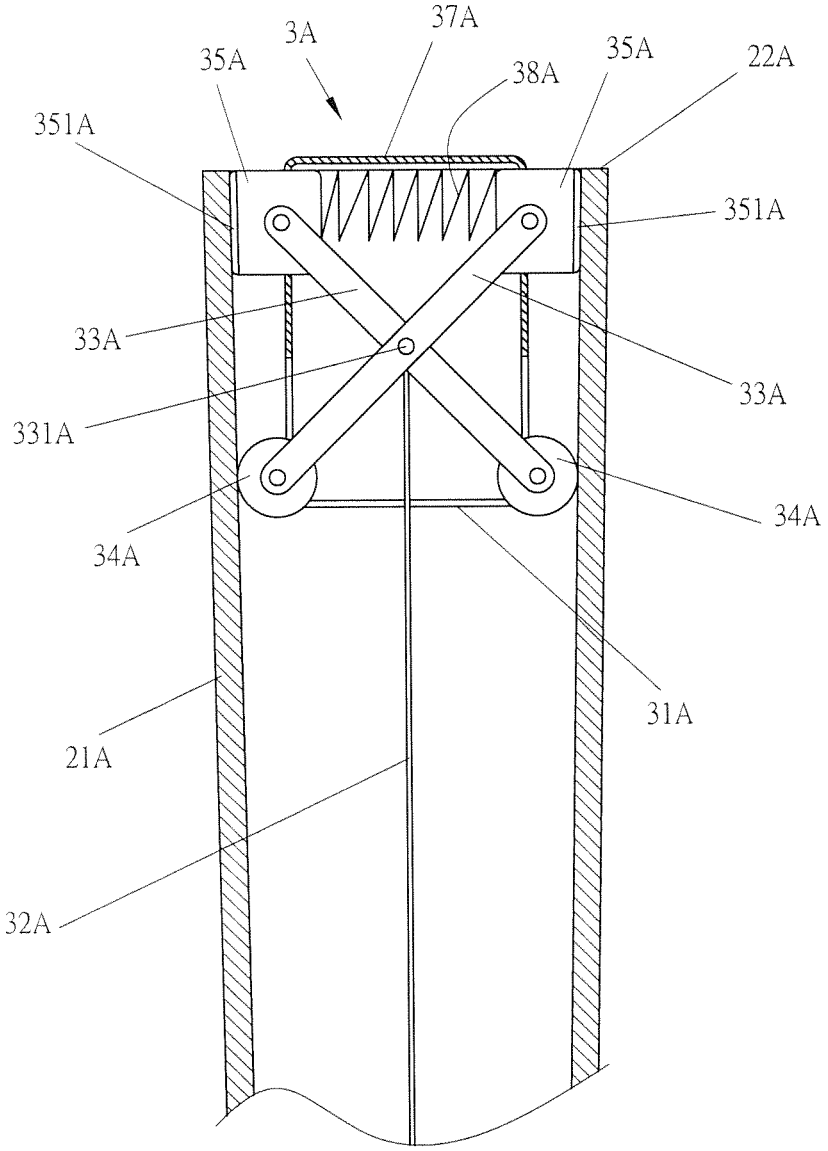
FIG. 8 is a schematic view of an escape device according to a second embodiment of the present invention, demonstrating the conformation of the deformable member while the deformable member associated with the elastic members is located at the relatively wide first end of the sliding track.
Figure 9:
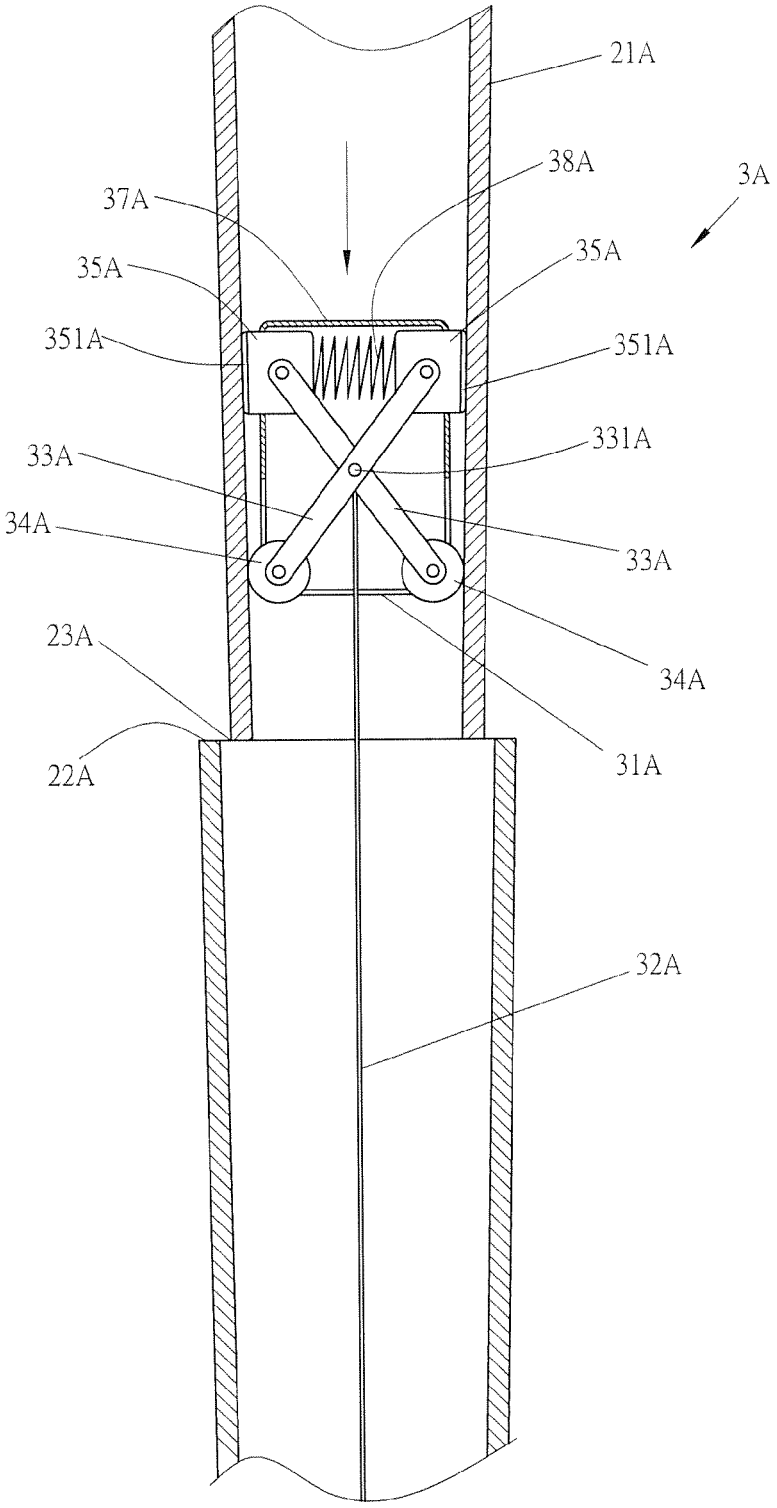
FIG. 9 is another schematic view of the escape device in FIG. 8, demonstrating the conformation of the deformable member while the deformable member associated with the elastic members is located at the relatively narrow second end of the sliding track.

With regard to a second embodiment of the present invention, reference is made to FIG. 8 and FIG. 9. This embodiment involves a sliding unit (3A) which includes a deformable member (31A) mounted with a hanging member (32A), wherein the deformable member (31A) has an outer shell (37A) in which two supporting rods (33A) are arranged in a cross manner and are pivotally connected to each other via a pivot joint (331A). The two supporting rods (33A) each have a first end provided with a respective roller wheel (34A) and a second end, opposite to the first end, mounted with an respective elastic member (35A). Each of the elastic members (35A) comprises an anti-slide portion (351A) for increasing the friction coefficient between the elastic members (35A) and a sliding track (21A). Further, a spring element (38A) is connected between the two elastic members (35A) in order to enhance the sustenance between the two elastic members (35A).

The second embodiment of the present invention is characterized by the deformable member (31A) in which the roller wheels (34A) are associated with the elastic members (35A). During the escape, the deformable member (31A) is put into the sliding track (21A). The sliding track (21A) is tapered from a relatively wide first end (22A) to a relatively narrow second end (23A), and the deformable member (31A) is put in from the first end (22A) of the sliding track (21A). Consequently, when the deformable member (31A) slips from the first end (22A) to the second end (23A) of the sliding track (21A), the deformable member (31A) is pressed against and deformed by the second end (23A) of the sliding track (21A) and thus a slide resistance which is sufficient to reduce the sliding velocity of the sliding unit (3A) is generated. Meanwhile, the two roller wheels (34A) are gradually driven to move inwardly, i.e., toward each other, due to the tapered conformation of the sliding track (21A), and thus the supporting rods (33A) mounted with the roller wheels (34A) are driven to move accordingly and thereby lead the elastic members (35A) to move inwardly such that the spring element (38A) connected between the elastic members (35A) are compressed and generates a rebounding force at the same time. The rebounding force pushes the elastic members outwardly (35A) and enhances the slide resistance and thus further decreases the sliding velocity of the sliding unit (3A). Because the slide resistance is varied at least by the spring constant of the spring element (38A), users of different body weights can all escape safely by replacing the spring element (38A) according to their respective body weights. In this way, the suitable elastic supporting force may be provided and the purpose of safe escape can be fulfilled thereby.

Figure 10:
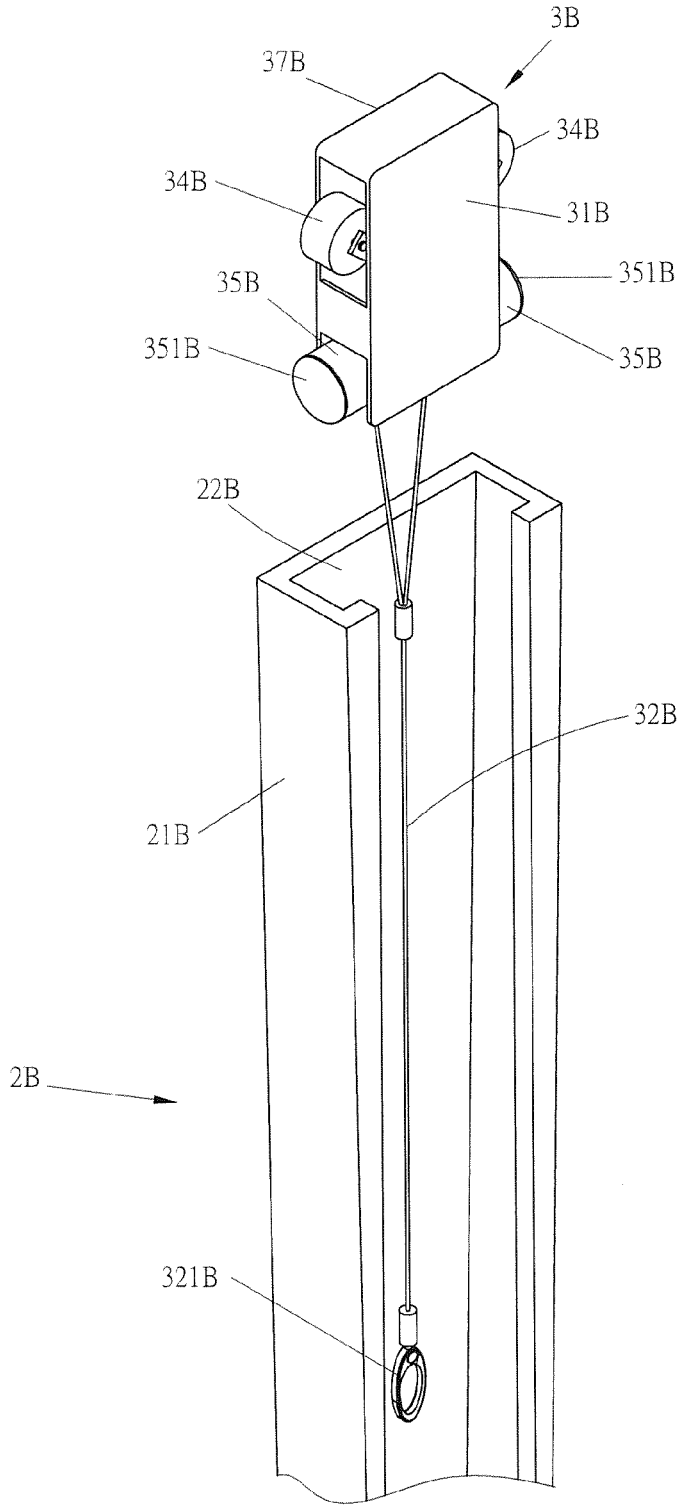
FIG. 10 is a perspective view of an escape device according to a third embodiment of the present invention.
Figure 11:
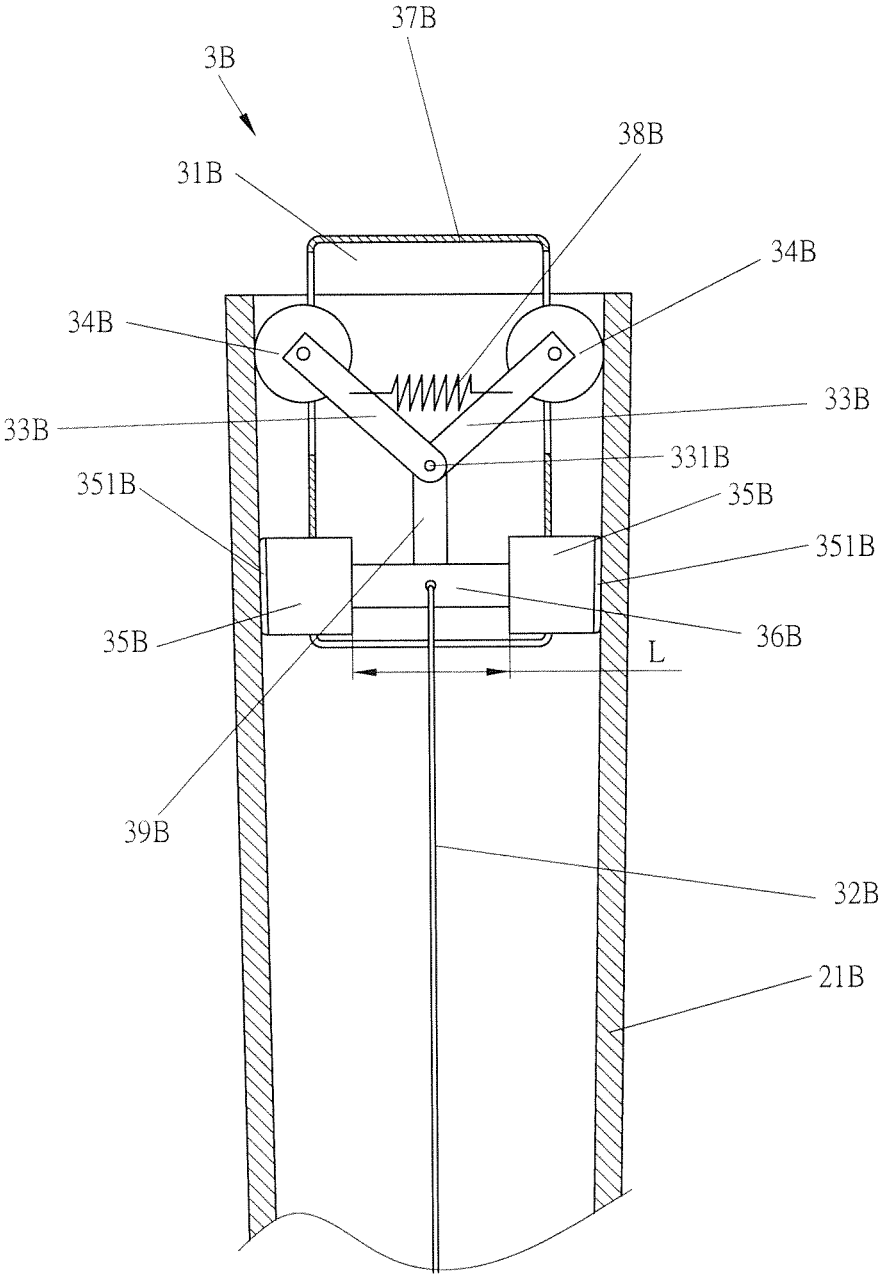
FIG. 11 is a schematic view of the escape device in FIG. 10, demonstrating the conformation of the deformable member while the deformable member associated with the magnetic components is located at the relatively wide first end of the sliding track.
Figure 12:
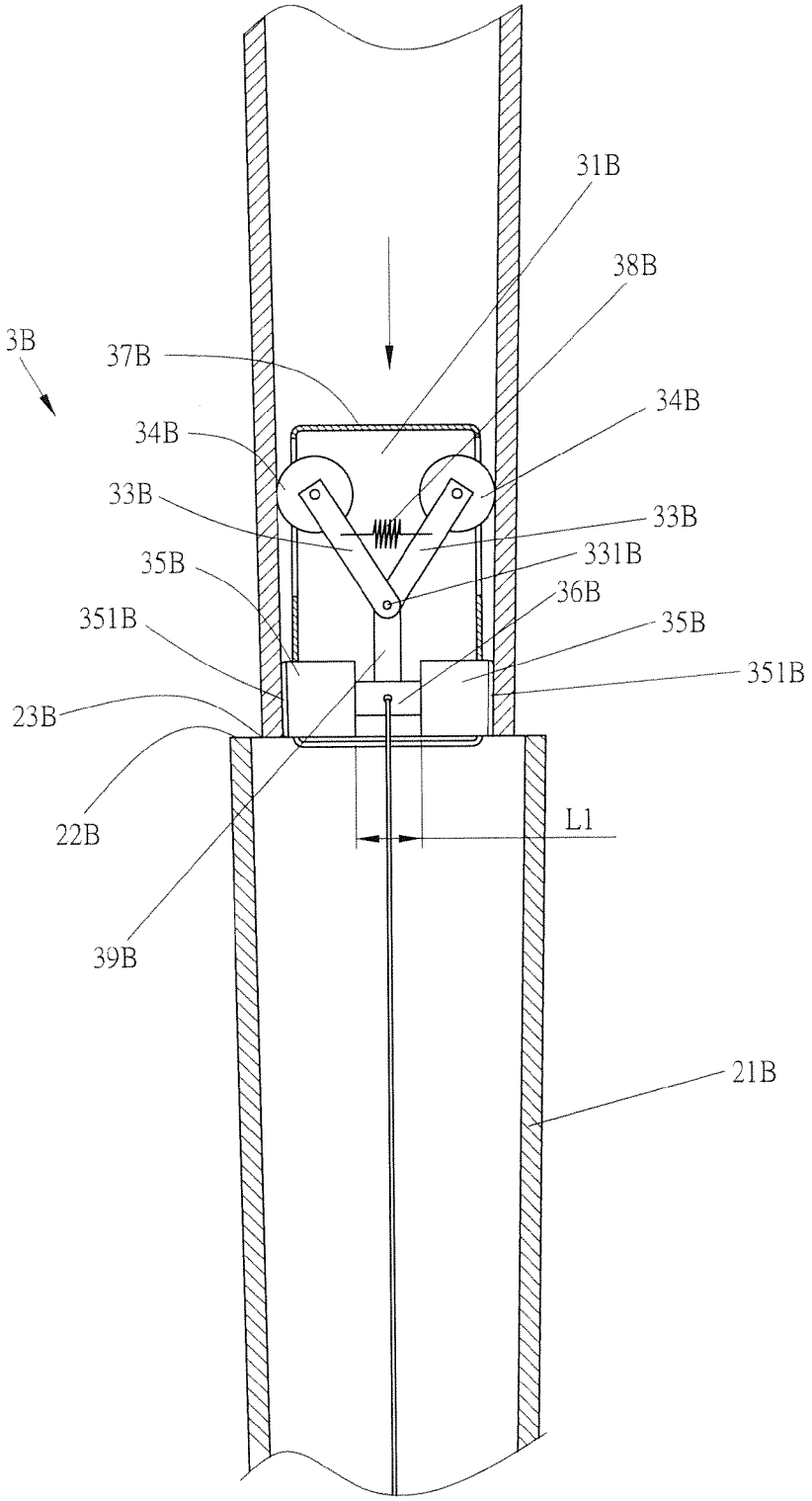
FIG. 12 is still another schematic view of the escape device in FIG. 10, demonstrating the conformation of the deformable member while the deformable member associated with the magnetic components is located at the relatively narrow second end of the sliding track.

With regard to a third embodiment according to the present invention, reference is made to FIGS. 10 to 12. This embodiment involves a sliding unit (3B) which includes a deformable member (31B) mounted with a hanging member (32B), wherein the deformable member (31B) comprises an outer shell (37B) in which a pivot rod (39B) is arranged therein. The pivot rod (39B) has a first end pivotally connected with two supporting rods (33B) via a pivot joint (331B) and a second end mounted with a connecting rod (36B). Each of the two supporting rods (33B) has one end, opposing the pivot joint (331B), mounted with a roller wheel (34B) for sliding in a sliding track (21B) of a rail member (2B). Two ends of the connecting rod (36B) each are provided with a magnetic component (35B), and more specifically, the two magnetic components (35B) are movable relative to the connecting rod (36B) and are opposite to each other with the same magnetic pole, e.g., the north pole, so that the two magnetic components (35B) can be spaced apart by a first distance (L) because of magnetic repulsion. Further, each of the two magnetic components (35B) has an anti-slide portion (351B) which comes in contact with the sliding track (21B) in order to increase the friction between the magnetic components (35B) and the sliding track (21B). Moreover, a spring element (38B) can be provided between the two supporting rods (33B) in order to enhance the sustenance between the two supporting rods (33B).

The third embodiment of the present invention is characterized by the deformable member (31B) in which the roller wheels (34B) are associated with the magnetic components (35B). To use, the deformable member (31B) is put in the sliding track (21B). The sliding track (21B) is tapered from a relatively wide first end (22B) to a relatively narrow second end (23B), and the deformable member (31B) is put in from the first end (22B) of the sliding track (21B). At this moment, the two magnetic components (35B) still spaced apart by the first distance (L) due to magnetic repulsion. However, when the roller wheels (34B) associated with the magnetic components (35B) slip down to the second end (23B), the two magnetic components (35B) get closer to each other because of being pressed against by the second end (23B) of the sliding track (21B) so that the distance between the two magnetic components (35B) is reduced to a second distance (L1). As a result, a repulsion force between the two magnetic components (35B) is enhanced to make the two magnetic components (35B) be pressed more firmly against the sliding track (21B), and thus a friction is generated to slow down the slipping velocity of the roller wheels (34B) associated with the magnetic components (35B). In this embodiment, the friction is controlled at least by the strength of the repulsion force between the two magnetic components (35B). Therefore, users with different body weights can all escape safely by replacing the magnetic components (35B) according to their respective body weights.

Based upon the abovementioned second and third embodiments, the present invention can be carried out either by associating the roller wheels (34A) with the elastic members (35A) or by associating the roller wheels (34B) with the magnetic components (35B) so that the elastic supporting force can be used in the present invention to cause changes in the friction resulting from the contact with the sliding track (21A) or the magnetic repulsion can be used to cause changes in the friction resulting from the contact with the sliding track (21B). Therefore, the present invention reaches the effect of "multi-stage buffering" as well as fulfills the purpose of safe and rapid escape.

Figure 13:
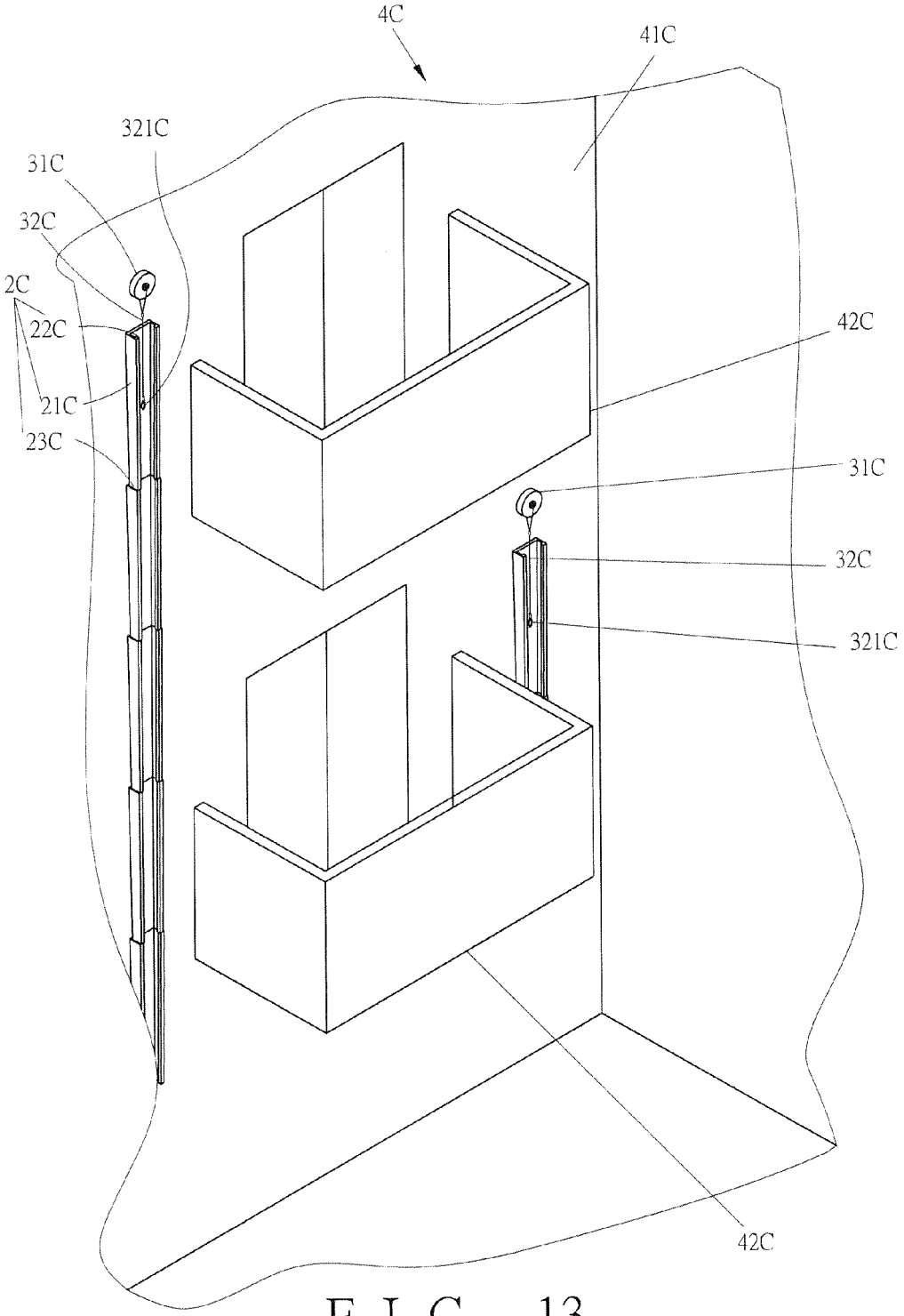
FIG. 13 is a schematic view of an escape device according to a fourth embodiment of the present invention, showing that the escape device can be mounted outside a building and a balcony of the building can be served as an escape hatch.

Referring to FIG. 13, in a fourth embodiment of the present invention, each floor (41C) of a building (4C) has a balcony (42C) served as the abovementioned escape hatch (13), and the escape device of this embodiment is mounted on an outer wall of the building (4C) without damage to the structure of the building (4C), wherein the escape device can be mounted by means of screw.

In the course of the escape, each user can associate himself/herself with a hanging member (32C) by means of a hook element (321C), then puts a deformable member (31C) mounted with the hanging member (32C) into a first end (22C) of a sliding track (21C) of a rail member (2C), and finally escapes from the balcony (42C) by slinging himself/herself downwards to the ground. Because the sliding track (21C) of the rail member (2C) is tapered from the first end (22C) to an opposing second end (23C), the deformable member (31C) is pressed against and gradually deformed when slipping down from the first end (22C) to the second end (23C) of the sliding track (21C), such that a slide resistance which is sufficient to reduce the descending velocity of the user is generated between the second end (23C) and the deformable member (31C). However, the descending velocity will resume when the deformable member (31C) slips out of the second end (23C) of the sliding track (21C) and into the first end (22C) of another adjacent sliding track (21C), thus avoiding wasting too much time for the escape. The escape device according to this embodiment can be either integrally built with the building (42C) or extra mounted on the outer wall of the building (4C) after the construction of the building has been completed.

Figure 14:
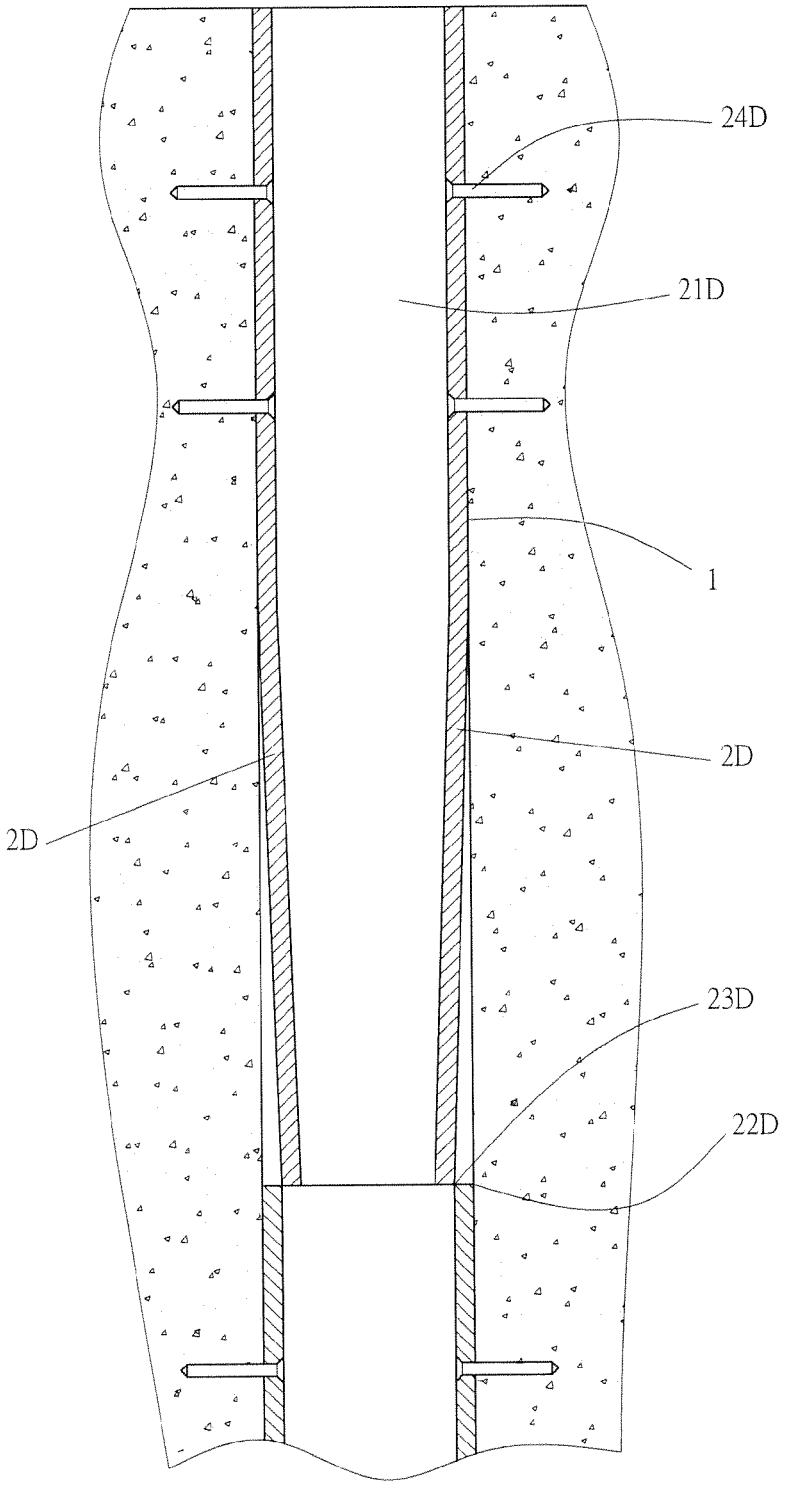
FIG. 14 is a partial schematic view of an escape device according to a fifth embodiment of the present invention.
Figure 15:
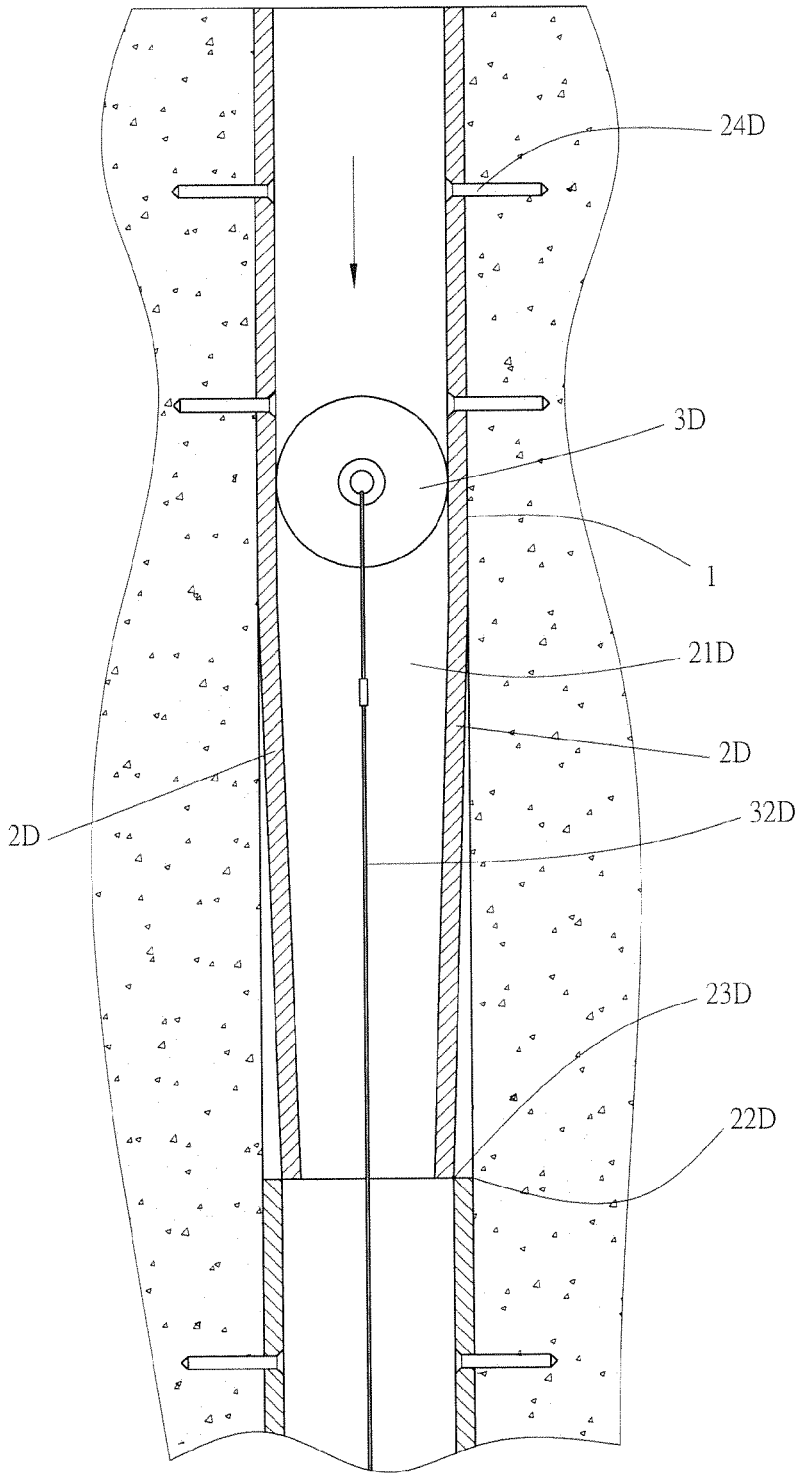
FIG. 15 is another partial schematic view of the escape device in FIG. 14, demonstrating the conformation of the rail member while the sliding unit is located at the first end of the sliding track.
Figure 16:
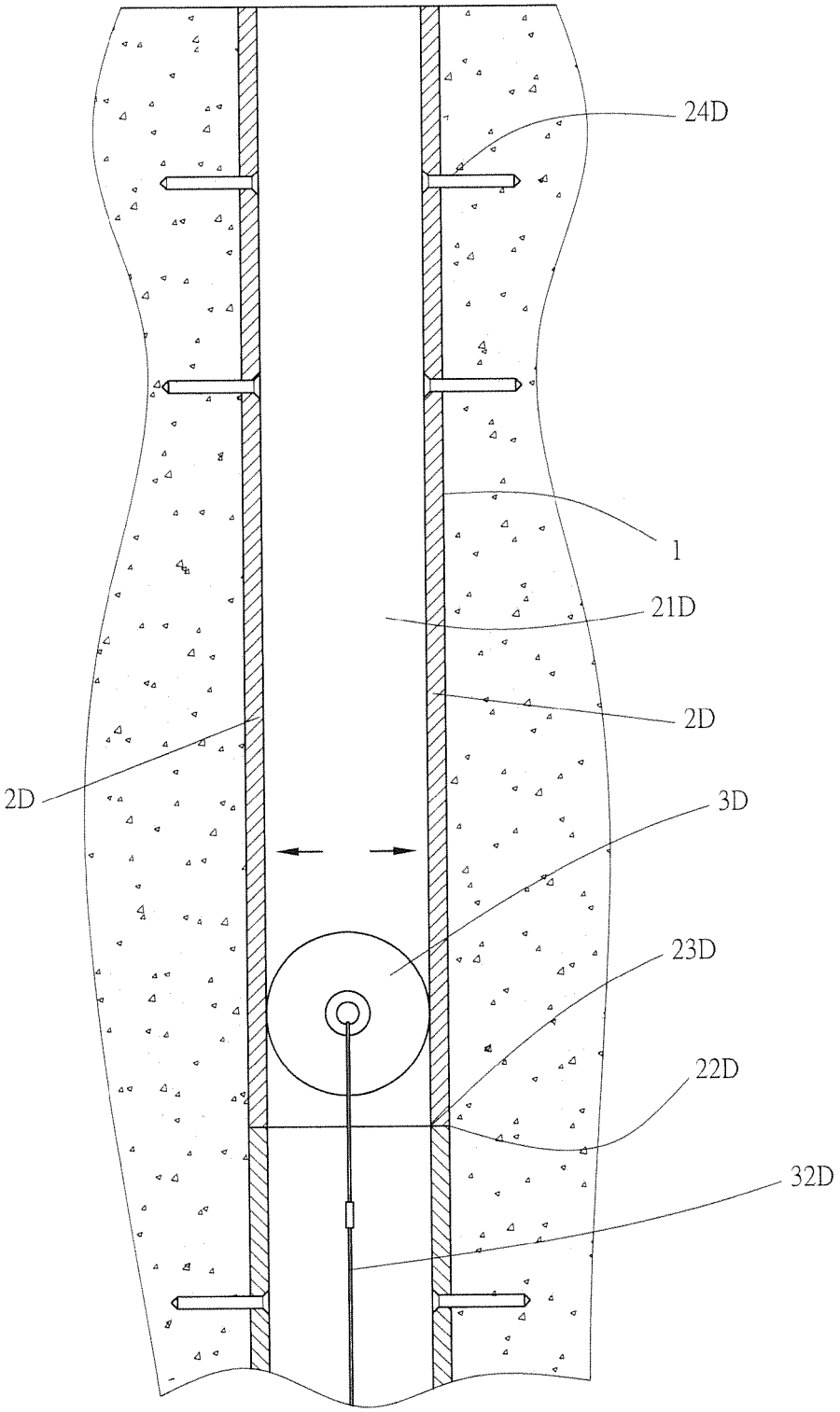
FIG. 16 is still another partial schematic view of the escape device in FIG. 14, demonstrating the conformation of the rail member while the sliding unit is located at the second end of the sliding track.

Referring to FIGS. 14, 15, and 16, in a fifth embodiment of the present invention, two rail members (2D) are mounted in pair on the inner surface of the abovementioned tube (1) via fixing holes (24D). The two rail members (2D) constitute a sliding track (21D). The sliding track (21D) has a relatively wide first end (22D) and a relatively narrow second end (23D) and is tapered from the first end (22D) to the second end (23D). The second end (23D) of the sliding track (21D) is connected to the first end (22D) of another adjacent sliding track (21D) which is constituted by another pair of said rail members (2D).

A sliding unit (3D), including a hanging member (32D), is adapted to slide along the sliding track (21D). Due to the tapered conformation of the sliding track (21D), the sliding unit (3D) is pressed against when slipping down to the second end (23D) of the sliding track (21D), and thereby a slide resistance between the sliding unit (3D) and the second end (23D) of the sliding track (21D) is generated to reduce sliding velocity of the sliding unit (3D).

It is characterized in that the rail members (2D) are elastic, while the sliding unit (3D) is made of rigid material. Therefore, when the sliding unit (3D) slides down to the second end (23D) of the sliding track (21D), the rail members (2D) are pressed to elastically bend outwardly by the sliding unit (3D), and thus the second end (23D) of the sliding track (21D) expands in the transverse direction. At the same time, a slide resistance is sufficiently generated to reduce sliding velocity of the sliding unit (3D). It is noted that the second end (23D) of the sliding track (21D) will recover to its original state once the sliding unit (3D) slips out of the second end (23D) of the sliding track (21D).

Figure 17:
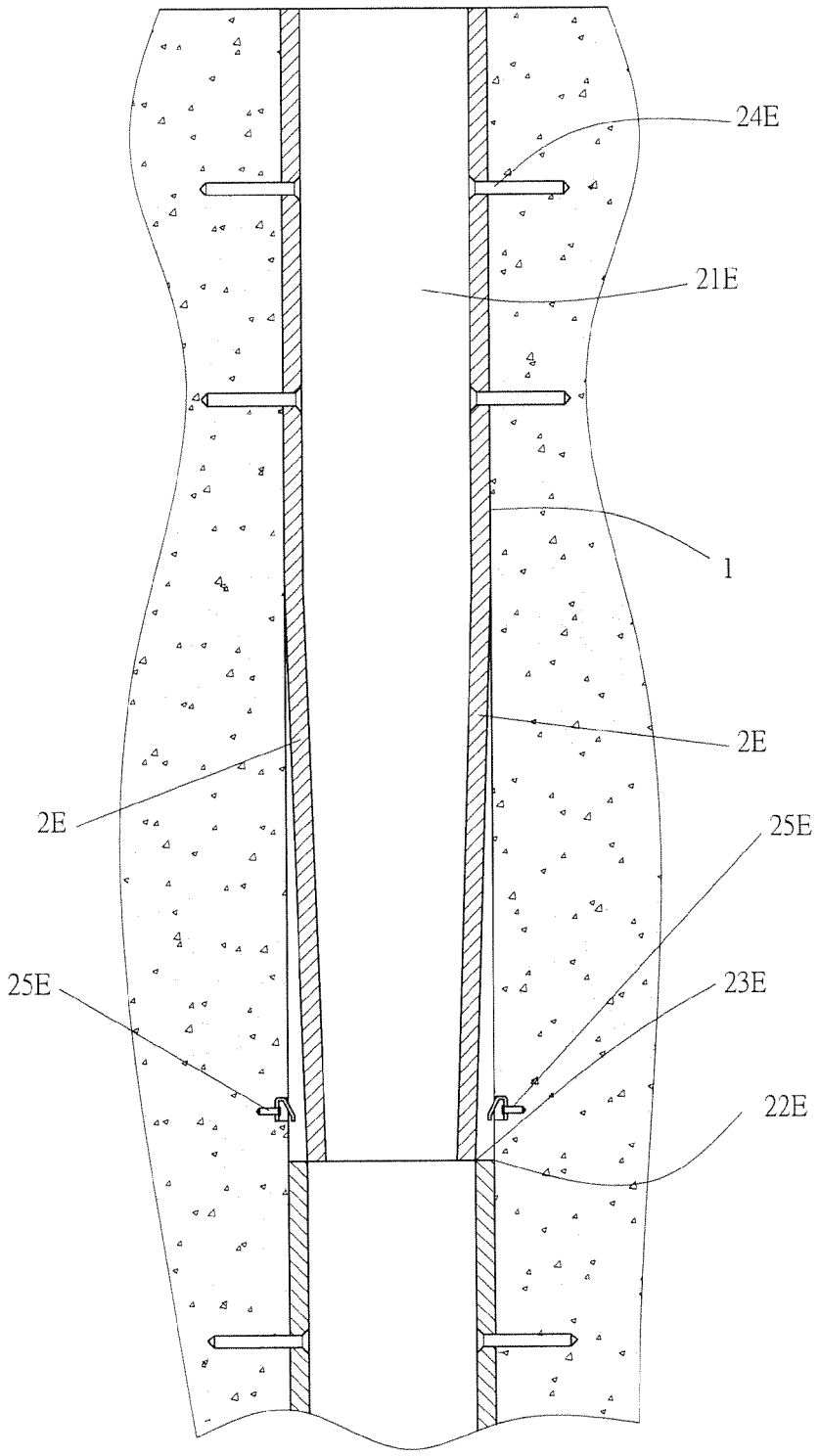
FIG. 17 is a partial schematic view of an escape device according to a sixth embodiment of the present invention.
Figure 18:
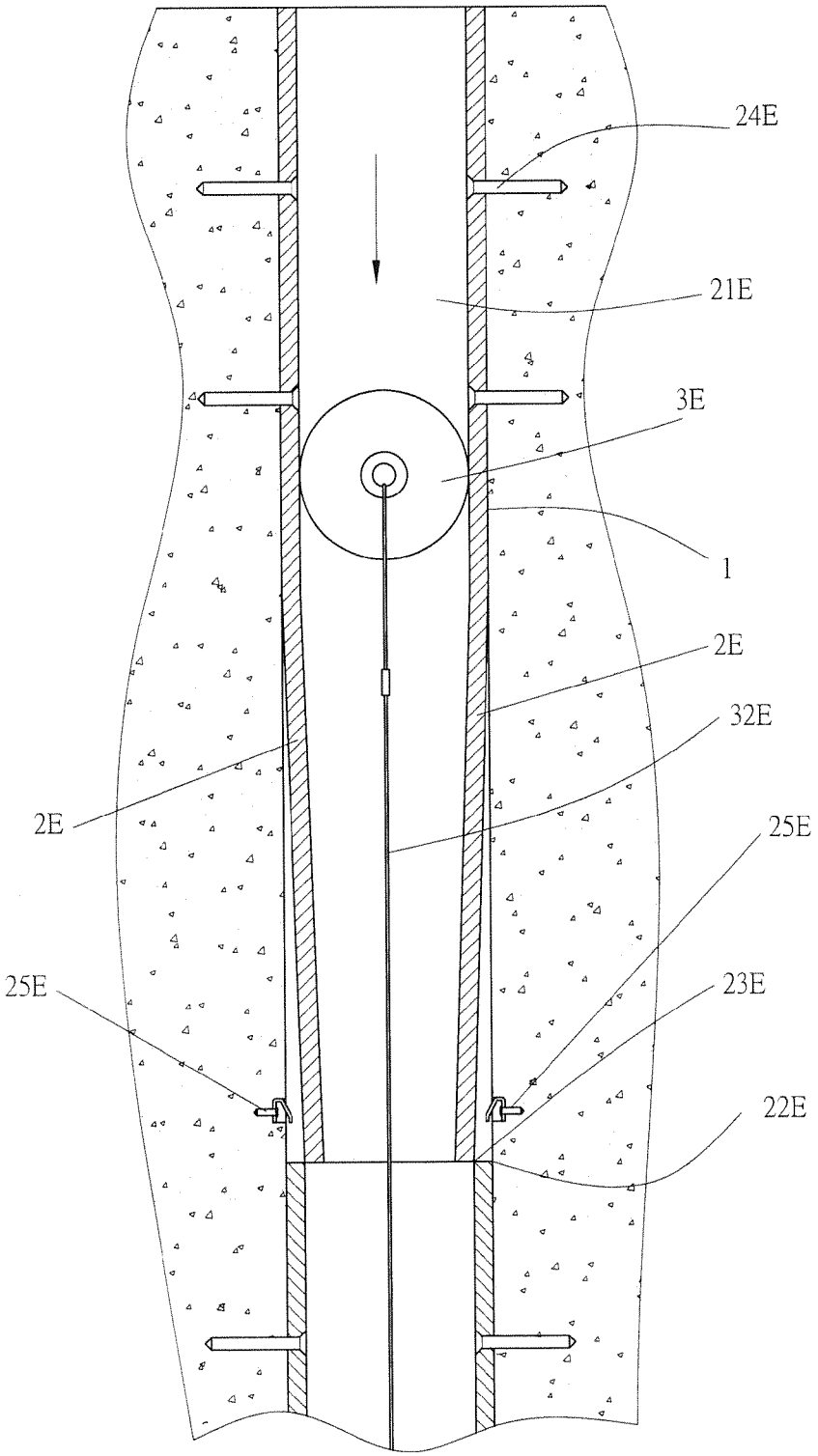
FIG. 18 is another partial schematic view of the escape device in FIG. 17, demonstrating the conformation of the rail member while the sliding unit is located at the first end of the sliding track.
Figure 19:
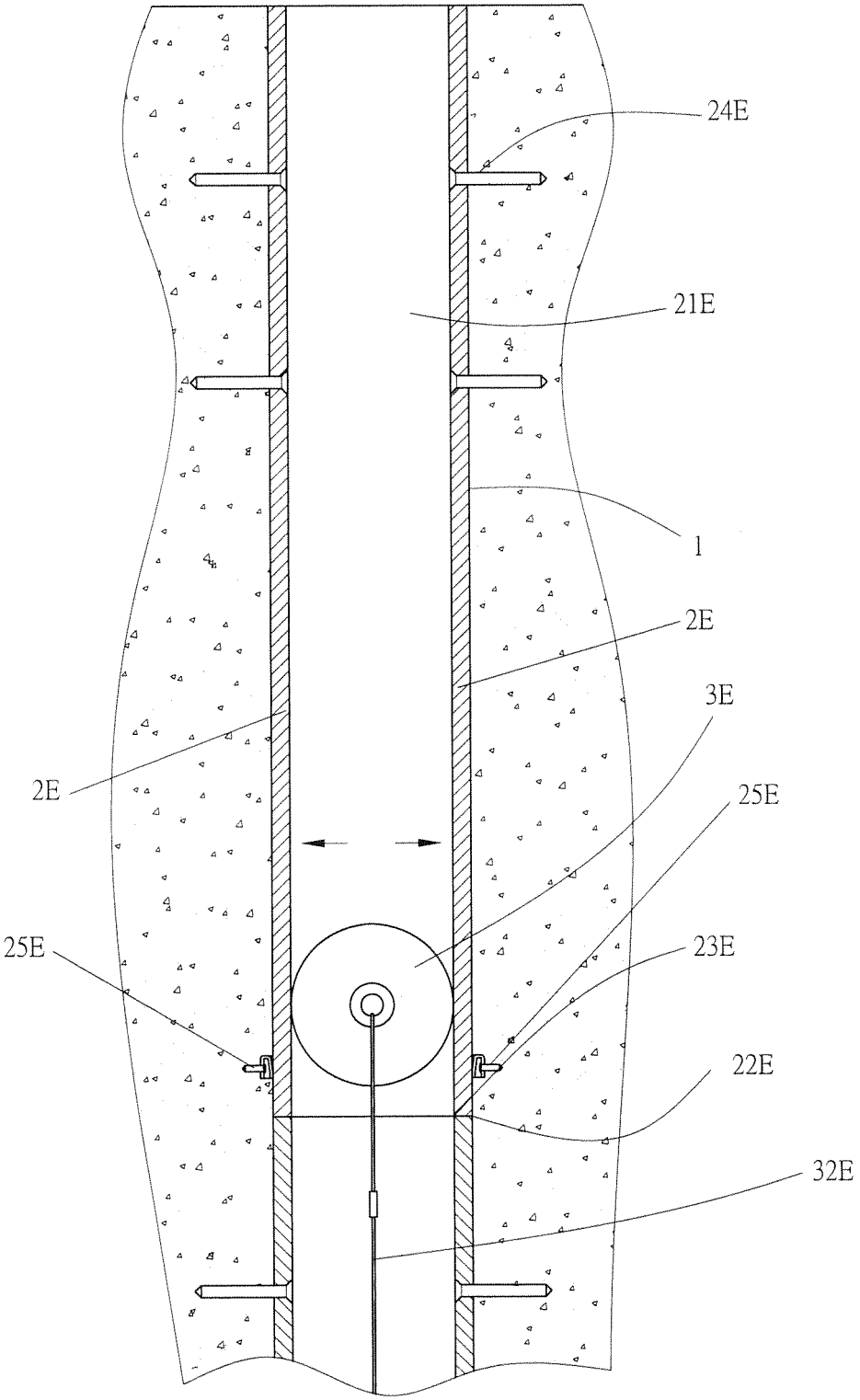
FIG. 19 is still another partial schematic view of the escape device in FIG. 17, demonstrating the conformation of the rail member while the sliding unit is located at the second end of the sliding track.

Referring to FIGS. 17 to 19, in a sixth embodiment of the present invention, two rail members (2E) are mounted in pair on the inner surface of the abovementioned tube (1) via fixing holes (24E). The two rail members (2E) constitute a sliding track (21E). The sliding track (21E) includes a relatively wide first end (22E) and a relatively narrow second end (23E) and is tapered from the first end (22E) to the second end (23E). The second end (23E) of the sliding track (21E) is connected to the first end (22E) of another adjacent sliding track (21E). Furthermore, a spring component (25E) is mounted at the contact site between the second end (23E) of the sliding track (21E) and the tube (1) for the purpose of assisting the second end (23E) in returning to its original form.

A sliding unit (3E), including a hanging member (32E), is adapted to slip along the sliding track (21E). Due to the tapered conformation of the sliding track (21E), the sliding unit (3E) is pressed against when slipping to the second end (23E) of the sliding track (21E), and thereby a slide resistance is generated between the sliding unit (3E) and the second end (23E) of the sliding track (21E) to reduce the sliding velocity of the sliding unit (3E).

It is characterized in that the rail members (2E) are elastic, while the sliding unit (3E) is made of rigid material. Therefore, when the sliding unit (3E) slips down to the second end (23E) of the sliding track (21E), the rail members (2E) are pressed to elastically bend outwardly by the sliding unit (3E), and thus the second end (23E) of the sliding track (21E) expands in the transverse direction. Meanwhile, a slide resistance is sufficiently generated to reduce sliding velocity of the sliding unit (3E). Moreover, the spring component (25E) helps the rail members (2E) recovering to its original form once the sliding unit (3E) slips out of the second end (23E) of the sliding track (21E).

From the explanations for the foregoing embodiments, operations, use and effect of the present invention could be sufficiently understood. The abovementioned embodiments are the preferred embodiments of the present invention, and the scope of the present invention, however, may not be hence limited. In other words, any simple equivalent amendment and modification made according to claims and description of the present invention falls within the scope of the present invention.

What is claimed is:

1. An escape device, comprising:

a rail member, extending along a longitudinal direction, wherein the rail member includes a plurality of sliding tracks sequentially connected to one another along the longitudinal direction, each of the sliding tracks having a first end defining an opening wider than an opening at a longitudinally opposed second end, an intermediate portion extending between the longitudinally opposed first and second ends, the intermediate portion having laterally opposed sloped wall surfaces defining a tapered profile, wherein sequentially disposed pairs of the sliding tracks are connected with the second end of one connected to the first end of the other; and a sliding unit including at least one deformable member and a hanging member extending therefrom, wherein the deformable member slides on the rail member and is slidably captured between the sloped wall surfaces, and when the deformable member slides from the first end to the second ends of each sliding tracks in response to gravity, the deformable member is pressed against and deformed by the sloped wall surfaces to generate a slide resistance therebetween to reduced sliding velocity of the sliding unit.

2. The escape device according to claim 1, further comprising a tube extending along the longitudinal direction, wherein a lower portion of the tube has an exit end provided with an exit opening, at least one escape opening is provided on the tube along the longitudinal direction, the rail member is mounted on an inner surface of the tube, and the second ends of the sliding tracks facing the exit end of the tube.

3. The escape device according to claim 1, wherein the hanging member includes a hook element.

4. The escape device according to claim 1, wherein the deformable member deforms with respect to an original state when a force is applied thereon, and the deformable member returning to the original state upon removal of the force.

5. The escape device according to claim 1, wherein the deformable member is made of elastic material.

6. The escape device according to claim 1, wherein the deformable member includes two supporting rods which are arranged in a cross manner and pivotally connected to each other, the two supporting rods each have a roller wheel mounted thereon such that the deformable member is slidable on the rail member via the roller wheels, and the two supporting rods have a spring element connected therebetween.

7. The escape device according to claim 1, wherein the deformable member includes a pivot rod having a first end pivotally connected with two supporting rods and a second end mounted with a connecting rod, each of the two supporting rods is provided with a roller wheel for sliding on the rail member, and the connecting rod has two ends each of which is provided with a magnetic component, the magnetic components being opposite to each other with the same magnetic pole.

8. The escape device according to claim 2, wherein at least one monitoring unit and an alarm unit are mounted at the exit opening of the tube, and the monitoring unit being in communication with the alarm unit.

9. The escape device according to claim 1, further comprising a hook element attached to an end of the hanging member, the hook element being either one of a snap ring or a carabiner.

* * * * *